US007489229B2

(12) United States Patent
Jöllenbeck et al.

(10) Patent No.: US 7,489,229 B2
(45) Date of Patent: Feb. 10, 2009

(54) FUSE COMPONENT

(75) Inventors: André Jöllenbeck, Bochum (DE); Uwe Röder, Witten (DE); Andreas Baus, Dortmund (DE)

(73) Assignee: Wickmann-Werke GmbH, Witten (DE)

( * ) Notice: Subject to any disclaimer, the term of this patent is extended or adjusted under 35 U.S.C. 154(b) by 666 days.

(21) Appl. No.: 10/479,880

(22) PCT Filed: Jun. 11, 2002

(86) PCT No.: PCT/EP02/06392

§ 371 (c)(1),
(2), (4) Date: Apr. 16, 2004

(87) PCT Pub. No.: WO02/103735

PCT Pub. Date: Dec. 27, 2002

(65) Prior Publication Data

US 2004/0169578 A1 Sep. 2, 2004

(30) Foreign Application Priority Data

Jun. 11, 2001 (DE) ..... 101 28 108

(51) Int. Cl.
*H01H 85/046* (2006.01)
*H01H 85/08* (2006.01)

(52) U.S. Cl. ..... 337/297; 337/227; 337/231

(58) Field of Classification Search ..... 337/227, 337/231, 297; 29/623
See application file for complete search history.

(56) References Cited

U.S. PATENT DOCUMENTS 4,626,818 A * 12/1986 Hilgers ..... 337/166
4,749,980 A * 6/1988 Morrill et al. ..... 337/232
5,166,656 A 11/1992 Badihi et al.
5,169,465 A * 12/1992 Riley ..... 156/89.17
5,453,726 A * 9/1995 Montgomery ..... 337/290

(Continued)

FOREIGN PATENT DOCUMENTS

JP 08102244 4/1996

(Continued)

OTHER PUBLICATIONS

Pierson, Hugh, Handbook of Refractory Carbides and Nitrides, Properties, Characteristics, Processing and Applications, Noyles Publications, Westwood, New Jersey, 1996, pp. 223-247.*

(Continued)

*Primary Examiner*—Anatoly Vortman
(74) *Attorney, Agent, or Firm*—Bell Boyd & Lloyd, LLP

(57) ABSTRACT

A fuse component includes an electrically insulating substrate having a top surface, a thick film fuse element applied to the top surface and a cover layer. The cover layer is made of an electrically insulating material having good caloric conductivity. The cover layer can be directly applied to the thick film fuse element and the adjoining zones of the top surface of the substrate. The cover layer can contain a glass having a specific caloric conductivity of >2 W/mK. The cover layer can have a window disposed above a section of the fuse element, the section of the fuse element located within the window being at least partially covered by a solder containing layer.

9 Claims, 3 Drawing Sheets

U.S. PATENT DOCUMENTS 5,652,562 A * 7/1997 Riley ..... 337/405
5,907,272 A * 5/1999 McGuire ..... 338/22 R
5,949,323 A * 9/1999 Huggins et al. ..... 337/401
5,949,465 A * 9/1999 Taniguchi et al. ..... 347/205
5,968,426 A * 10/1999 Hirao et al. ..... 264/43
5,977,860 A * 11/1999 Ulm et al. ..... 337/297
6,040,754 A * 3/2000 Kawanishi ..... 337/297
6,118,109 A * 9/2000 Sako ..... 219/542
6,518,546 B2 * 2/2003 Otsuka et al. ..... 219/216
6,614,341 B2 * 9/2003 Martin ..... 337/297

FOREIGN PATENT DOCUMENTS

WO WO 96/41359 12/1996

OTHER PUBLICATIONS

Searle, Tim, Properties of Amorphous Silicon and its Alloys, INSPEC, London,1998, pp. 379-382.*
Zvei, Information on Fuses, Sheet No. 7, 03.01 (www.sicherungen.de/files/foliensatz1.ppt>).

* cited by examiner

FUSE COMPONENT

BACKGROUND OF THE INVENTION

The invention relates to a fuse device, in which a thick film fusible conductor is applied to an upper surface of an electrically insulating substrate, and to a method of manufacturing such a fuse device.

Fuse devices of the type referred to above are disclosed in the prior art in a series of publications. Reference is made by way of example to the fuse for SMD installation described in WO 96/41359 A1. Formed on a rectangular surface of an insulating substrate, which consists, for instance, of $Al_2O_3$, between two connecting surfaces, is a metallic thick film fusible conductor. The connecting surfaces are formed on opposing edges of the surface of the substrate and are composed of a plurality of metal layers and are provided for the purpose of SMD installation with a solderable coating. A spot comprising a layer, which contains tin/lead, is applied to a central section of the fusible conductor applied to the surface of the substrate. The configuration is so designed that in the event of predetermined current flows of predetermined minimum durations the fusible conductor and the spot applied on it heat up to an extent which is sufficient to soften or to melt the material of the spot to the extent that the tin/lead metal diffuses into the metal of the fusible conductor disposed beneath it. This locally increases its electrical resistance, which results in an increased voltage drop, an increased local power loss, further heating and finally in melting and/or vaporisation of the material of the fusible conductor. The current which results in the described manner in rupturing of the fusible conductor is less than the current which would be necessary for melting the fusible conductor without the applied tin/lead spot. However, as a result of the described, time-consuming processes, a considerably longer time of the current flow is necessary until rupture (tripping); the fuse device is very "sluggish".

On the other hand, U.S. Pat. No. 5,166,656 discloses a very rapidly acting SMD fuse for protecting electronic circuits, in which a metallic thin film fusible conductor with a thickness of 0.6 to 4.5 μm is applied to a glass substrate and is covered with a passivation layer of CVD $SiO_2$ or imprinted glass, whereafter a second glass plate is secured to it with an adhesive layer (epoxide).

Slow acting fuses of small size are required, for instance, in telecommunication devices, particularly to protect input circuits or interface circuits, which are coupled to long transmission lines. These transmission lines are subjected to the influences of electric and magnetic fields which are produced by lightening strikes and high voltage cables extending in the vicinity. These influences can result, amongst other things, in brief current/voltage pulses with high peak values on the telecommunication signal transmission lines, which can potentially damage the devices connected to them, particularly their input circuits. The input connections of the device are thus protected against over-voltages and, with the aid of fusible protection devices, against excessive currents. These telecommunication devices or their fuse devices are subjected to complicated requirements, which are specified in a series of special tests. On the one hand, "telecommunications" fuse devices should reliably trip (that is to say no longer enable the flow of current even by way of an arc) at currents of predetermined magnitude within predetermined maximum current flow periods (e.g. at 40 A within 1.5 s or at 7 A within 5 s). Furthermore, the fuse devices should be slow acting, that is to say if their maximum permissible current is slightly exceeded they trip (rupture) after a relatively long duration of the current flow. Finally, they should be able to resist brief (in the millisecond range) relatively large currents of up to 100 A without tripping (such currents are produced e.g. in the event of over-voltage pulses, which are dissipated to earth by an over-voltage protective device with a low internal resistance, whereby the current which is produced flows via the fuse element). The requirements on devices with "telecommunications" fuse devices are specified e.g. in the "UL 1950", "FCC Part 68" and "Bellcore 1089" tests.

It is the object of the invention to provide a fuse device which renders it possible to satisfy the requirements referred to above with a small structural size and low manufacturing costs and which furthermore can be constructed in the form of an SMD component.

BRIEF SUMMARY OF INVENTION

This object is solved by a fuse device including an electrically insulating substrate with an upper surface: a thick film fusible conductor applied to the uppersurface of the substrate: and a cover layer comprising an electrically insulatingmaterial of good thermal conductivity applied directly to the thick film fusible conductor and adjoining regions of the upper surface of the substrate, whereby thespecific thermal conductivity of the material of the cover layer is greater than 2 W/mK. Furthermore this obiect is solved by a method of manufacturing a fuse device, wherein a thick film fusible conductor is applied to an upper surface of anelectrically insulating substrate and a cover layer of an electrically insulating materialof good thermal conductivity is applied directly onto the thick film fusible conductor and adioining regions of the upper surface of the substrate, wherein the specificthermal conductivity of the material of the cover layer is greater than 2 W/mK.

The fuse device in accordance with the invention has an electrically insulating substrate with an upper surface, a thick film fusible conductor applied to the surface of the substrate and a cover layer of an electrically insulating material of good thermal conductivity applied directly to the thick film fusible conductor and adjoining regions of the surface of the substrate. It is possible with this arrangement to improve the resistance of the fuse device to very briefly flowing high currents in a manner which is simple to manufacture (namely a simple structure with few layers). The cover layer has a number of complementary effects: it stabilises the surface of the fusible conductor, it acts as a brief thermal buffer (or thermal drain and store) and it can inhibit the production and maintenance of an arc during and after tripping.

Electrically insulators generally have, in comparison to conductive materials (such as metals), a poor thermal conductivity. The term "good thermal conductivity" in the context of the invention should therefore be understood as thermal conductivity which is above average for an electrical insulator. The specific thermal conductivity of the material of the cover layer should be greater than 2 W/mK, preferably greater than 4 W/mK. The cover layer is produced e.g. from a paste applied in a screen printing process by tempering, the paste containing particles of at least one substance from a good thermally conducting group of substances including glasses, aluminium oxide, aluminium nitride and silicon nitride. In another preferred exemplary embodiment, the cover layer is a sintered thick film containing a glass which was produced from a glass frit by tempering at a temperature between 700° C. and 900° C., preferably about 850° C. The cover layer is preferably relatively thick, for instance 10 μm-100 μm, preferably 20 μm-40 μm, thick.

The substrate is preferably a ceramic substrate with a good thermal conductivity, for instance a ceramic $Al_2O_3$ substrate.

In a preferred embodiment, the substrate has an elongate, substantially rectangular upper surface, the thick film fusible conductor extending between two connecting surfaces disposed at the narrow sides of the surface, the connecting surfaces not being covered by the cover layer. The surface has e.g. a width between 1 mm and 4 mm and a length between 6 mm and 15 mm.

The thick film fusible conductor preferably has a width between the connecting surfaces of between 0.1 mm and 1.5 mm.

This small substrate size for thick film fuse devices permits a relatively large width (preferably in conjunction with a relatively large layer thickness), a relatively large cross-sectional area of the fusible conductor and thus a high current capacity, which (and also the cover layer in accordance with the invention) inhibits rupturing under brief current pulses of high amplitude.

In a preferred embodiment of the fuse device, the thick film fusible conductor extends, at least in a central section, between the connecting surfaces in a serpentine shape (i.e. in loops in opposite directions). It is thus possible to increase the length of the fusible conductor, which has a relatively large cross-sectional area, with a small size of the substrate surface. With this sizing possibility, different rated currents can be achieved with approximately the same momentary pulse resistance.

In a preferred embodiment of the fuse element in accordance with the invention, the cover layer has at least one window, which is arranged over a section of the fusible conductor. The section of the fusible conductor situated in the window is at least partially covered by a layer, which contains a substance, which, when heated, can act on the fusible conductor situated beneath it such that the electrical resistance of the section of the fusible conductor increases. The window can be of any desired shape but, when producing the layers by a screen printing process, is preferably of approximately rectangular shape with edges aligned in the screen printing direction. The window can be formed exclusively on the fusible conductor layer or can be so wide that regions of the substrate surface adjacent to the fusible conductor are also exposed. The substance in the layer applied in the window is, for instance, a metal, which can diffuse into the fusible conductor. For instance, the fusible conductor contains silver and the substance contains lead and/or tin. The arrangement is so designed that in the event of predetermined current flows of predetermined minimum durations, heating of the fusible conductor and the layers applied thereon occurs, which is sufficient to permit the substance in the layer to act on the fusible conductor disposed beneath it. This locally increases its electrical resistance, which results in an increased voltage drop, an increased local power loss, further heating and finally in melting and/or vaporisation of the material of the fusible conductor. The current intensity, which results in the described manner in rupturing of the fusible conductor, is smaller than the current intensity, which would be necessary to melt the fusible conductor without the layer applied in the window. However, as a result of the aforementioned, time-consuming processes, a considerable longer time of the current flow is necessary until rupturing (tripping) occurs; the fuse device becomes more slow acting.

The layer containing the metal preferably has a good thermal conductivity. This provides the possibility of rapidly dissipating heat which is produced in the fusible conductor beneath it as a result of momentary current pulses. The layer thus adopts a function of the cover layer lacking in the window. The entire section of the fusible conductor situated in the window is preferably covered by the layer so that the entire fusible conductor is covered either by the heat-dissipating cover layer or by the layer applied in the window. The layer can furthermore overlap with the edge of the window in order to compensate for technologically determined tolerances.

In one exemplary embodiment, the thick film fusible conductor extends, at least in a central section, between the connecting surfaces in a serpentine shape with alternating straight and arcuate sections on the surface of the substrate. The window in the cover layer is disposed above an arcuate section and portions of the two adjacent straight sections of the loop of the fusible conductor and at least the arcuate section of the fusible conductor is covered by the layer containing the substance. In this exemplary embodiment, of the sections of the serpentine fusible conductor exposed in the window (not covered by the cover layer), at least the sections with the locally highest current densities (namely the arcs) are covered by the layer (e.g. a solder layer) applied in the window.

A preferred embodiment of the fuse device is characterised in that a protective plastic layer is applied above the cover layer. This consists preferably of a self-quenching plastic material, e.g. a self-quenching epoxide resin.

In the method in accordance with the invention for manufacturing a fuse device, a thick film fusible conductor is applied to an upper surface of an electrically insulating substrate. A cover layer of an electrically insulating material of good thermal conductivity is applied directly to the thick film fusible conductor and adjoining regions of the surface of the substrate.

In order to apply the thick film fusible conductor, a paste is preferably imprinted in a screen printing process. The layer thus formed is tempered. These application steps are preferably repeated at least once in order to increase the layer thickness. The production of a relatively thick fusible conductor is thus rendered possible, which permits a high current capacity, which results in an improved pulse resistance (see the explanation above). In order to apply the cover layer, a paste is preferably also imprinted in a screen printing process and the layer thus formed is subsequently tempered (fired). The paste is preferably a glass frit, which is tempered, after imprinting, at a temperature of between 700° C. and 950° C., preferably about 850° C.

In a preferred embodiment, the cover layer is so imprinted that at least one window is formed in the cover layer above a section of the fusible conductor. A layer is applied in the window, at least above a portion of the section of the fusible conductor, which contains a substance, which, when heated, can act on the fusible conductor disposed beneath it such that the resistance of the section of the fusible conductor increases. In a preferred embodiment, a solder-containing layer is imprinted in the window and then briefly melted. A solder layer with a thickness of between 70 μm and 130 μm is preferably imprinted with the aid of a template. This relatively thick solder layer creates a good local thermal absorption buffer and an excess of the metals diffusing into the fusible conductor.

Advantageous and preferred embodiments of the invention are characterised in the dependent claims.

BRIEF DESCRIPTION OF DRAWINGS

The invention will be described below in more detail with reference to preferred embodiments illustrated in the drawings, in which.

DETAILED DESCRIPTION OF INVENTION

Figure 1A:
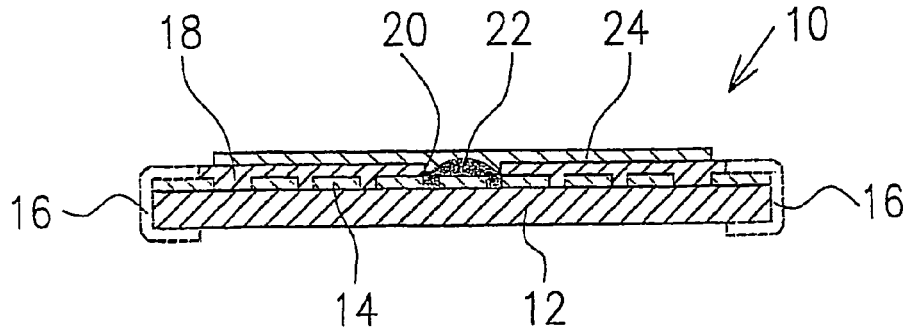
FIG. 1*a* is a sectional view of the fuse device of FIG. 1 along the line A-A.
Figure 1:
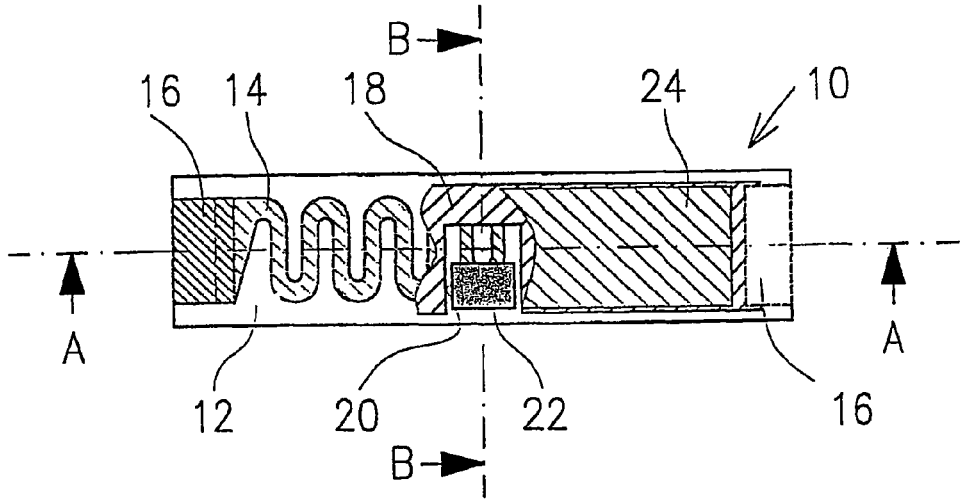
FIG. 1 is a schematic plan view of a first embodiment of a fuse device in accordance with the invention with cover layers partly cut away.
Figure 1B:
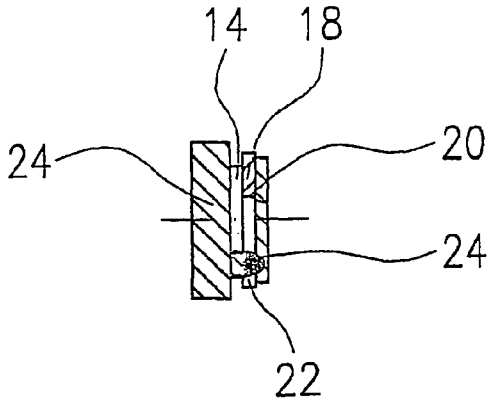
FIG. 1*b* is a sectional view of the fuse device of FIG. 1 along the line B-B.

FIG. 1 is a schematic plan view of a fuse device 10 in accordance with the invention, the upper layers being partially cut away for reasons of visualisation. FIGS. 1*a* and 1*b* are sectional views of the fuse device 10 shown in FIG. 1, the section being on the line A-A and B-B, respectively. The fuse device 10 is produced on a substrate 12. In the preferred embodiment, the substrate comprises an $Al_2O_3$ ceramic with a thickness between 0.5 mm and 0.7 mm, for instance 0.63 mm. The substrate 12 illustrated in FIG. 1 of the preferred exemplary embodiment is about 10 mm long and 2.5 mm wide. The illustrated substrate chip is preferably cut out from a larger substrate wafer, whereby a plurality of fuse device chips arranged in rows and columns can be fabricated simultaneously on the substrate wafer.

Applied to the upper surface of the substrate 12 shown in FIG. 1 is a thick film fusible conductor 14. The fusible conductor 14 comprises a layer, which is applied by screen printing and sintered, of adjoining silver particles and preferably has a thickness of about 20 μm. Such a thickness is produced, for instance, by successively imprinting two layers of 10 μm thickness each, whereby after imprinting the first layer it is firstly fired before the second layer is imprinted. The thick film fusible conductor 14 has a serpentine shape, the width of the fusible conductor in the serpentine region being about 0.2 mm. In the vicinity of the narrow sides of the substrate 12, the fusible conductor 14 adjoins contact surfaces 16. The contact surfaces 16 can also be produced from the film of the fusible conductor 14 and/or from further films. The contact surfaces 16 extend around the outer edges of the substrate with the exception of the (not shown in FIG. 1) underside of the substrate 12. The contact surfaces 16 preferably comprise a galvanically produced layer system with a subsequently applied solder layer.

Applied above the fusible conductor 14 and the adjacent exposed regions of the upper surface of the substrate 12 is a cover layer 18. In the exemplary embodiment shown in FIG. 1, the cover layer 18 covers nearly the entire surface of the substrate 12 with the exception of the contact surfaces 16 and a window 20 (which will be described below in more detail). The cover layer 18 is preferably produced with the aid of a screen printing process, in which a glass frit is imprinted and subsequently tempered (fired) so that a thickness of the cover layer of e.g. about 20 μm is produced. The components of the glass frit are so selected that a layer with a relatively good thermal conductivity forms. In the exemplary embodiment illustrated in FIG. 1, the cover layer does not extend to the longitudinal sides of the substrate 12 so that, on a substrate wafer with a plurality of chips arranged in rows and columns, strips remain between the chips which are free of the cover layer 18. These strips can serve to optically mark the chip borders and facilitate separation. Furthermore, spacing of the cover layer from the parting region between the chips prevents a negative influence on the layer 18 by the separation process (e.g. sawing or scoring/cracking).

As already mentioned, the cover layer 18 has a window 20. The window 20 is so arranged that a loop of the serpentine fusible conductor is exposed in the window, the loop comprising a curve and straight sections connected to it of the fusible conductor. The window 20 is preferably arranged approximately in the middle of the fuse device 10. With an approximately symmetrical construction of the serpentine fusible conductor 14, the region of the strongest heating is produced in the centre of the fuse device 10. A layer 22 is applied in the window 20 above the curved portion of the section of the fusible conductor exposed in the window, the layer 22 being produced by imprinting a solder-containing paste with the aid of a printing template and subsequent heating until the solder components briefly melt. The solder-containing layer imprinted in the template has, for instance, a thickness of about 100 μm. After the brief melting, a permanent drop-shaped construction is produced after the cooling process as a result of the surface tension of the molten material, which is shown, for instance, in FIG. 1*a*. The solder material contained in the layer 22 is, for instance, a tin/lead alloy. In addition to tin and lead, further metals can be included in the alloy. In the exemplary embodiment shown in FIG. 1, the window 20 extends 1 mm in the longitudinal direction of the substrate 12 and is about 1.5 mm wide. The layer applied in the window is about 0.7 mm wide and extends substantially over the entire length of the window.

The entire structure comprising the fusible conductor 14, cover layer 18 and the layer 22 applied in the window 20 is covered by a protective layer 24. However, the protective layer 24 leaves the contact surfaces 16 exposed. The protective layer 24 preferably consists of an epoxide reside, preferably a self-quenching epoxide resin. With the substrates referred to above, the thicknesses referred to above of the layers applied thereon and a thickness of the protective layer of less than 1 mm, the total thickness of the fuse device 10 thus produced remains significantly below 2 mm, so that the device satisfies the requirements of the mini-PCI shape factor.

The serpentine thick film fusible conductor 14 shown in FIG. 1 has a relatively large width and a relatively high thickness in order to provide an adequate current capacity for an improved pulse resistance. The serpentine shape permits a relatively large length of the fusible conductor resistance on the substrate 12 to be produced. Fuse elements 10 with different rated currents can be designed by differing resistance lengths. In a preferred embodiment, the fuse element has, for a rated current of 1.5 A, for instance, a resistance of about 90 mΩ and, for a rated current of 2 A, a resistance of 60 mΩ.

Different views of the substrate 12 of the fuse element 10 with layers applied thereon are shown in FIGS. 2*a* to 2*d* in order to show the sequence of the application of the individual layers in the manufacture of the fuse element.

Reference is made in each case to a chip in FIGS. 2*a* to 2*b* in the following description of the manufacture of the fuse device described with reference to FIG. 1. Reference is also made at this point to the fact that the described method steps are preferably performed on a substrate wafer which has a plurality of chips of the illustrated type arranged in rows and columns. The layers are thus applied simultaneously for a plurality of chips.

The layer 14 containing silver is firstly applied to the upper surface of the substrate 12 in a screen printing process. At its two ends, the fusible conductor layer 14 has diverging areas 26 which adjoin the contact surfaces 16. In the exemplary embodiment illustrated in FIG. 2*a*, all the bends are of the same length with the exception of the serpentine loop arranged in the centre. The serpentine loop arranged in the centre, which is subsequently to be covered with a solder layer, is displaced somewhat from the edge of the substrate 12 in order to achieve a better position of the solder spot and of the protective layer, as will be described in more detail below. After imprinting the layer 14, it is fired. A second fusible conductor layer is then imprinted with the same layout onto the fired first layer in order to achieve a greater thickness of the fusible conductor and is again fired.

Figure 2A:
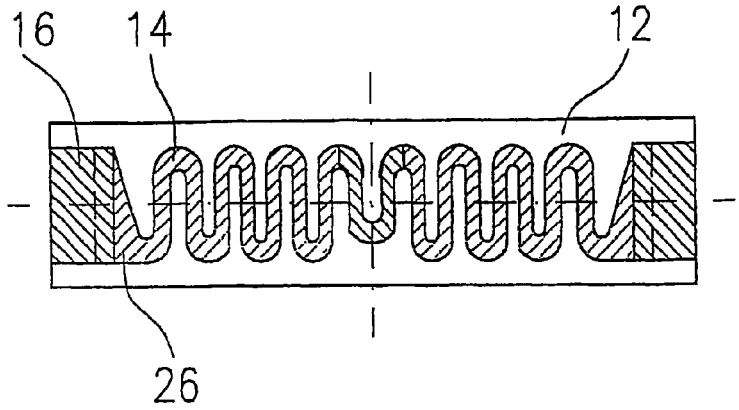
FIGS. 2*a*-2*d* are schematic views of a substrate with layers applied thereon, which illustrate method steps in the manufacture of the fuse device shown in FIG. 1.
Figure 2B:
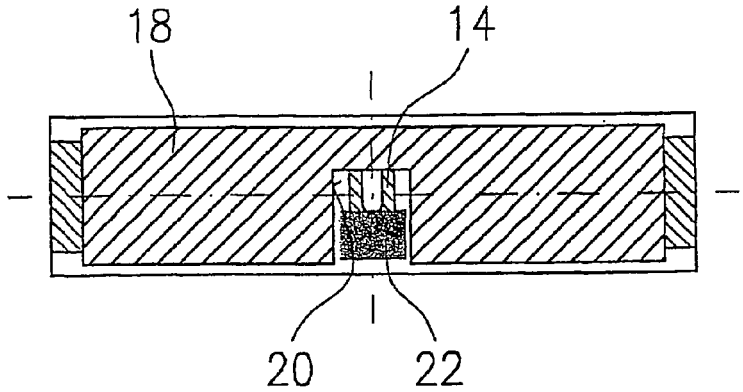
Figure 2C:
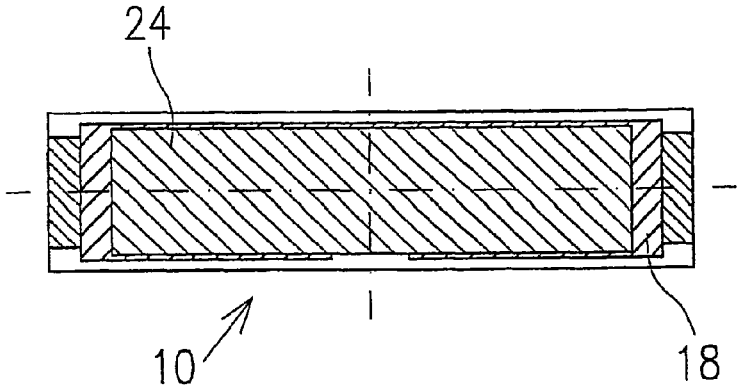

The cover layer 18 is then imprinted onto the fusible conductor layer 14, imprinted on the substrate 12 and fired, as is shown in FIG. 2*b*. In the present preferred exemplary embodiment a glass frit is applied in a screen printing process and subsequently tempered (fired) at a temperature of about 850° Celsius in order to produce a layer with a thickness of about 20 μm. The glass frit which is used with a firing temperature of 850° Celsius is commonly referred to as a "high-melting glass layer", since the firing or sintering temperature of 850° Celsius is above the firing temperature of about 500°-600° Celsius used with the glass frits which are otherwise common. The glass layer formed therefrom has a relatively high (for electric insulators) specific thermal conductivity of more than 3.5 W/mK, for instance a specific thermal conductivity of 4.3 W/mK. The cover layer 18 has a window 20, which, in this embodiment, is arranged at the edge of the cover layer 18 and is thus defined by only three edges. The central, shortened serpentine loop illustrated in FIG. 2*a* is arranged in the window 20.

After the tempering of the cover layer 18, a solder-containing layer 22 is imprinted by means of a template in the window 20 above the serpentine loop disposed therein. The layer 22 produced by stencil printing preferably has a thickness of about 10 μm. The layer 22 is so disposed within the window 20 that it completely covers the arc of the serpentine loop, whereby remaining between the edge of the solder-containing layer 22 and the edge, extending in the longitudinal direction of the window 20 there is a space, in which the two straight sections of the fusible conductive layer 14, which are connected to the arc of the bend, are exposed, i.e. are covered neither by the cover layer 18 nor by the solder-containing layer 22. This results in the exposed sections of the fusible conductive layer 14 being able to be subjected to a higher thermal loading since a thermally dissipating cover is missing in this region. This may, however, be less critical with the straight sections of the serpentine fusible conductor 14 because the highest (because they are asymmetrically distributed) current densities are produced in the arcuate sections.

Figure 2D:
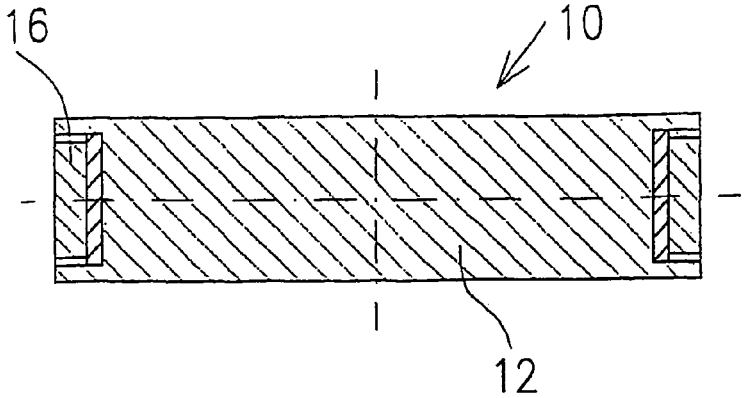

In a following method step, the layer structure thus produced is covered with a protective layer 24, for instance with an epoxide resin layer. In this exemplary embodiment, the protective layer has a thickness of up to 0.5 mm. After separation into strips of chips connected together at their longitudinal sides, the edge regions, including the connecting surfaces 16, of the fuse devices, including the edges, are galvanically metallised. A solder layer is applied to the galvanically applied sequence of layers in order to ensure good solderability of the devices thus produced. FIG. 2*d* shows the underside of the fuse device 10 thus produced. The contact surfaces 16 engage the underside of the substrate 12 around the sides and constitute their surfaces suitable for soldering.

Schematic views of a substrate with layers applied thereon are shown in FIGS. 3*a* to 3*d*, which illustrate method steps in the manufacture of an alternative embodiment of the fuse device in accordance with the invention. Since the method steps, i.e. the sequence of the application of the layers, do not differ from those described with reference to FIGS. 2*a* to 2*d*, only the differences will now be described.

Figure 3A:
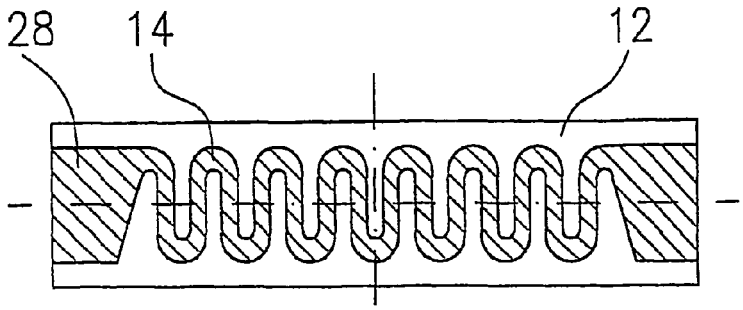
FIGS. 3*a*-3*d* are schematic views of a substrate with layers applied thereon, which illustrate method steps in the manufacture of an alternative embodiment of the fuse device in accordance with the invention.

Firstly, the layout of the fusible conductor layer 14 shown in FIG. 3*a* differs from that of the fusible conductor layer 14 shown in FIG. 2*a*. In the embodiment shown in FIG. 3*a*, all the serpentine loops are of the same length.

In the embodiment of FIG. 2*a*, the contact surfaces 16 are constituted by a separate metal layer, which is connected to the layer of the fusible conductor 14. In the embodiment of FIG. 3*a*, the contact surfaces 28 and the fusible conductor are constituted by the same layer.

Figure 3B:
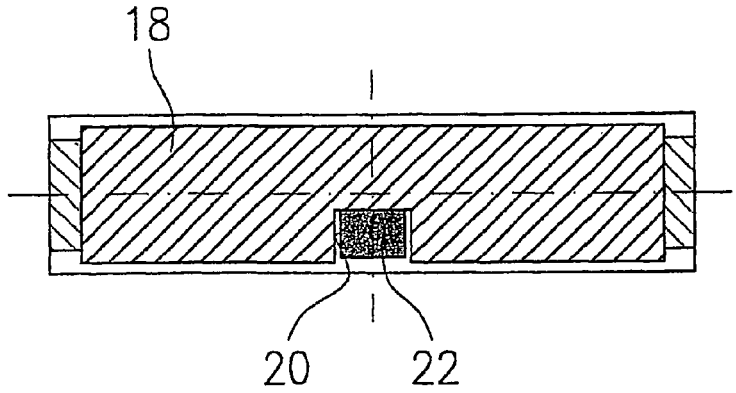

The window 20 in the cover layer 18 has a smaller width of only about 0.7 mm in the embodiment of FIG. 3*b* so that substantially only the arcuate section of the central serpentine loop is exposed in the window. Furthermore, in the embodiment of FIG. 3*b*, the solder-containing layer 22 is so applied that it extends to at least the edge of the window 20 parallel to the longitudinal sides so that the entire fusible conductor is covered either by the cover layer or by the solder-containing layer 22. This is currently the preferred embodiment; it ensures that all the sections of the thick film fusible conductor 14 are covered by a layer which dissipates heat.

Figure 3C:
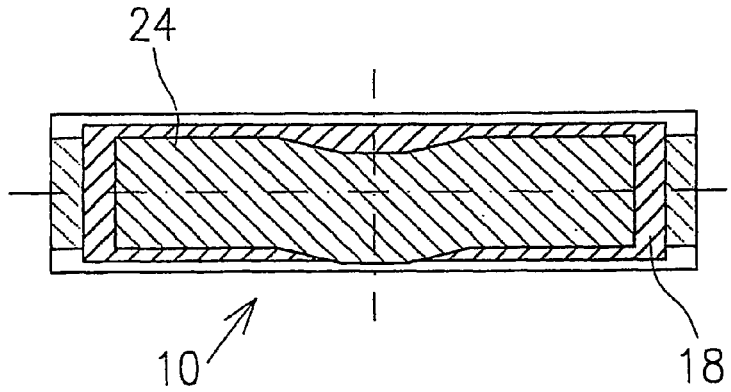
Figure 3D:
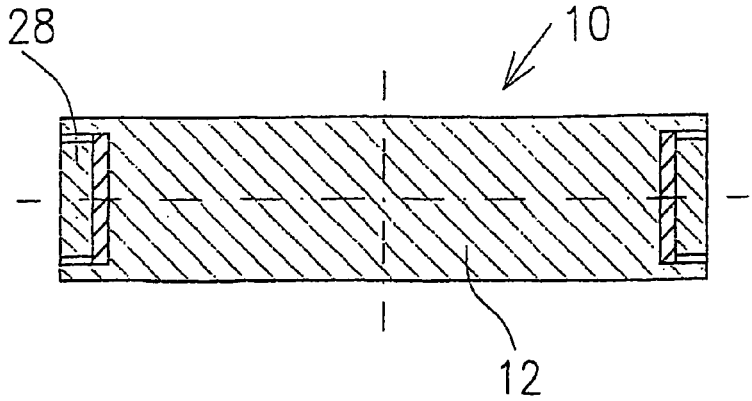

Since the central serpentine loop disposed in the window is not shortened and the solder-containing layer 22 is thus situated relatively distant on the edge of the fuse device, the protective layer 24 is displaced outwardly somewhat in the central region in order reliably to cover the solder spot 22, as is shown in FIG. 3*c*. Alternatively, the cover layer 14 can be moved as a whole further towards the edges of the substrate 12.

The invention has been described above with reference to the currently preferred embodiments. Numerous alternative embodiments are, however, possible within the scope of the inventive concept, as will be apparent from the attached claims.

The invention claimed is:

1. A fuse, comprising:

an electrically insulating substrate with an upper surface;

a thick film fusible conductor applied in a serpentine shape to the upper surface of the substrate;

a cover layer comprising an electrically insulating material of good thermal conductivity applied directly above the thick film fusible conductor and adjoining regions of the upper surface of the substrate;

a window in the cover layer, the window located above and near the center of the thick film fusible conductor;

a layer of a fusible metal in the window; and a protective layer atop the cover layer, the window and the layer, wherein the fuse is suitable for surface mounted devices (SMD).

2. The fuse according to claim 1, wherein the cover layer is a sintered layer.

3. The fuse according to claim 1, wherein the serpentine shape comprises a plurality of straight portions connected by a plurality of rounded arcuate portions.

4. The fuse according to claim 1, wherein the serpentine shape comprises a plurality of straight portions connected by a plurality of rounded arcuate portions, wherein two of the straight portions are shorter than a remainder of the plurality of straight portions.

5. A fuse, comprising:

an electrically insulating substrate with an upper surface;

a thick film fusible conductor applied in a serpentine shape to the upper surface of the substrate;

a cover layer comprising an electrically insulating material of good thermal conductivity applied directly above the thick film fusible conductor and adjoining regions of the upper surface of the substrate, wherein the specific thermal conductivity of the material of the cover layer is greater than 2 W/mK;

a window in the cover layer, the window located above and near the center of the thick film fusible conductor, the window located above a portion of the thick film fusible conductor with both straight and arcuate sections;

a layer of a fusible metal in the window; and a protective layer atop the cover layer, the window and the layer.

6. The fuse according to claim 5, further comprising connectors on ends of the electrically insulating substrate, wherein the connectors are electrically connected to the thick film fusible conductor but are not integral with the thick film fusible conductor.

7. The fuse according to claim 5, wherein the window is about 1 mm long and about 1.5 mm wide.

8. The fuse according to claim 5, wherein the electrically insulating substrate is about 0.5 to about 0.7 mm thick and the fuse is configured for use as a surface mounted device (SMD).

9. The fuse according to claim 5, wherein the layer of fusible metal in the window is a partially-melted paste.

* * * * *